US010421119B2

(12) United States Patent
Tallman

(10) Patent No.: US 10,421,119 B2
(45) Date of Patent: Sep. 24, 2019

(54) MOLD ASSEMBLY AND METHOD OF FORMING A COMPONENT

(71) Applicant: General Electric Company, Schenectady, NY (US)

(72) Inventor: James Albert Tallman, Glenville, NY (US)

(73) Assignee: General Electric Company, Schenectady, NY (US)

( * ) Notice: Subject to any disclaimer, the term of this patent is extended or adjusted under 35 U.S.C. 154(b) by 391 days.

(21) Appl. No.: 15/397,085

(22) Filed: Jan. 3, 2017

(65) Prior Publication Data

US 2018/0185913 A1 Jul. 5, 2018

(51) Int. Cl.

| | |
|---|---|
| ***B22C 9/04*** | (2006.01) |
| ***B22C 9/12*** | (2006.01) |
| ***B22C 9/24*** | (2006.01) |
| ***B22C 7/02*** | (2006.01) |
| ***B22D 25/02*** | (2006.01) |
| ***B22D 29/00*** | (2006.01) |
| ***B22D 30/00*** | (2006.01) |
| *F01D 5/18* | (2006.01) |

(52) U.S. Cl.

CPC ..... *B22D 25/02* (2013.01); *B22C 7/02* (2013.01); *B22C 9/043* (2013.01); *B22C 9/12* (2013.01); *B22C 9/24* (2013.01); *B22D 29/00* (2013.01); *B22D 30/00* (2013.01); *F01D 5/186* (2013.01); *F05D 2230/211* (2013.01); *F05D 2260/202* (2013.01)

(58) Field of Classification Search

CPC .. B22C 7/02; B22C 9/04; B22C 9/043; B22C 9/12; B22C 9/24; B22D 25/02; B22D 29/00; B22D 30/00

USPC ..... 164/27, 28, 30, 34, 45, 235, 246, 249, 164/361, 369, 365

See application file for complete search history.

(56) References Cited

U.S. PATENT DOCUMENTS

| | | | |
|---|---|---|---|
| 4,096,296 | A | 6/1978 | Galmiche et al. |
| 7,141,812 | B2 | 11/2006 | Appleby et al. |
| 8,793,871 | B2 | 8/2014 | Morrison et al. |
| 9,206,309 | B2 | 12/2015 | Appleby et al. |
| 2015/0321249 | A1 | 11/2015 | Shah et al. |
| 2015/0345304 | A1 | 12/2015 | Mongillo et al. |
| 2016/0159465 | A1 | 6/2016 | Koppelman et al. |
| 2016/0221262 | A1 | 8/2016 | Das et al. |
| 2016/0279885 | A1 | 9/2016 | Cantwell et al. |

*Primary Examiner* — Kevin P Kerns

(74) *Attorney, Agent, or Firm* — Armstrong Teasdale LLP

(57) ABSTRACT

A method of forming a component including coupling an array of receptacles to a mold core. Each receptacle in the array contains an amount of uncured mold material. The method further includes forming a layer of fugitive material on the mold core such that the array of receptacles is encapsulated within the layer of fugitive material. The method also includes forming a layer of uncured mold material on the layer of fugitive material, thereby forming an uncured mold assembly. The uncured mold assembly is heated to a temperature that solidifies the uncured mold material within each receptacle and of the layer, thereby forming an array of pins and a layer of solidified mold material. The uncured mold assembly is also heated to the temperature that removes the layer of fugitive material from between the mold core and the layer of solidified mold material such that a mold cavity, including the array of pins, is defined therebetween.

19 Claims, 5 Drawing Sheets

MOLD ASSEMBLY AND METHOD OF FORMING A COMPONENT

BACKGROUND

The present disclosure relates generally to forming components via casting and, more specifically, to an assembly and method for casting perforations directly into a component.

At least some metallic components are formed at least partially by casting. Some casting methods facilitate the production of near net shaped components where the component is substantially formed in one step during the casting process and finish machined to complete the component. For example, but not by way of limitation, some components, such as hot gas path components of gas turbines, are subjected to high temperatures. At least some such components have intricate shapes and contours such as, but not limited to, surface features for promoting cooling and structures to promote mixing of fluid streams.

At least some such known components are formed in a mold having a cavity that defines the external shape of the component. A molten metal alloy is introduced to the cavity of the mold and, in some methods, around a ceramic core, and cooled to form the component. However, an ability to produce an intricate near net component depends on an ability to precisely define the pattern used to create the mold. At least some known patterns are fragile, resulting in patterns and/or cores that are difficult and expensive to produce and handle without damage during the mold creation and casting process.

Alternatively or additionally, at least some known components are formed by drilling and/or otherwise machining the component to obtain the final shape, such as, but not limited to, using an electrochemical machining process. However, at least some such machining processes are relatively time-consuming and expensive. Moreover, at least some such machining processes cannot produce an outer wall having the features, shape, and/or contours required for certain component designs.

BRIEF DESCRIPTION

In one aspect, a method of forming a component is provided. The method includes coupling an array of receptacles to a mold core. Each receptacle in the array contains an amount of uncured mold material. The method further includes forming a layer of fugitive material on the mold core such that the array of receptacles is encapsulated within the layer of fugitive material, and forming a layer of uncured mold material on the layer of fugitive material, thereby forming an uncured mold assembly. The uncured mold assembly is heated to a temperature that solidifies the uncured mold material within each receptacle and of the layer, thereby forming an array of pins and a layer of solidified mold material, and heated to the temperature that removes the layer of fugitive material from between the mold core and the layer of solidified mold material such that a mold cavity including the array of pins is defined therebetween.

In another aspect, a mold assembly is provided. The mold assembly includes a mold core, an array of receptacles coupled to the mold core. Each receptacle in the array contains an amount of uncured mold material. A layer of fugitive material is formed on the mold core such that the array of receptacles is encapsulated within the layer of fugitive material, and a layer of uncured mold material is formed on the layer of fugitive material.

DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

Embodiments of the present disclosure relate to an assembly and method for casting perforations directly into a component. More specifically, the assembly includes an array of receptacles, where each receptacle in the array receives uncured mold material therein. The array is coupled to a ceramic mold core, encapsulated in a layer of fugitive material, and a layer of uncured mold material is formed over the layer of fugitive material. When heated, the fugitive material and the material used to form the array of receptacles are removed from between the ceramic mold core and the layer of uncured mold material. In addition, the uncured mold material solidifies such that a mold cavity for receiving component material in a fluid state is defined between the ceramic mold core and the layer of now solidified mold material. The uncured mold material in the receptacles likewise solidifies such that an array of pins is formed between the ceramic mold core and the layer of solidified mold material. As such, when the component material is introduced into the mold cavity, the array of pins facilitates forming perforations in the cast component. As such, the perforations are formed in the cast component in a quick, efficient, and cost effective manner.

Figure 1:
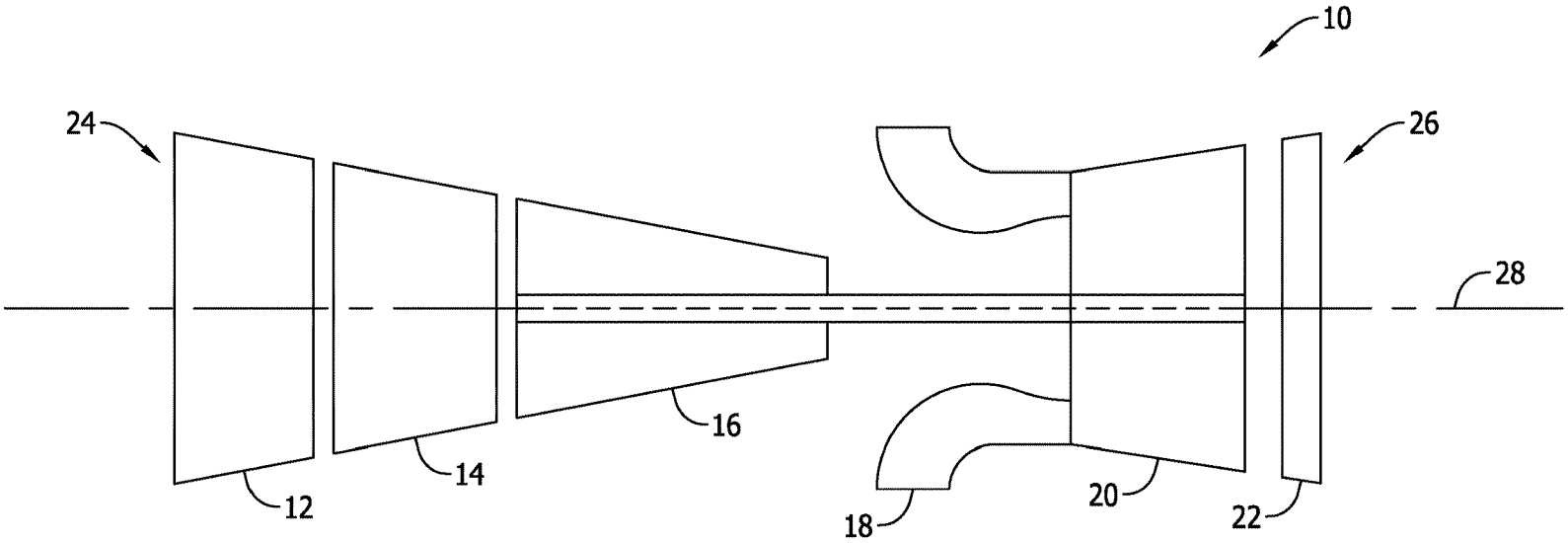
FIG. 1 is a schematic illustration of an exemplary turbine engine.

FIG. 1 is a schematic illustration of an exemplary turbine engine 10 including a fan assembly 12, a low-pressure or booster compressor assembly 14, a high-pressure compressor assembly 16, and a combustor assembly 18. Fan assembly 12, booster compressor assembly 14, high-pressure compressor assembly 16, and combustor assembly 18 are coupled in flow communication. Turbine engine 10 also includes a high-pressure turbine assembly 20 coupled in flow communication with combustor assembly 18 and a low-pressure turbine assembly 22. Turbine engine 10 has an intake 24 and an exhaust 26. Turbine engine 10 further includes a centerline 28 about which fan assembly 12, booster compressor assembly 14, high-pressure compressor assembly 16, and turbine assemblies 20 and 22 rotate.

In operation, air entering turbine engine 10 through intake 24 is channeled through fan assembly 12 towards booster compressor assembly 14. Compressed air is discharged from booster compressor assembly 14 towards high-pressure compressor assembly 16. Highly compressed air is channeled from high-pressure compressor assembly 16 towards combustor assembly 18, mixed with fuel, and the mixture is combusted within combustor assembly 18. High temperature combustion gas generated by combustor assembly 18 is channeled towards turbine assemblies 20 and 22. Combustion gas is subsequently discharged from turbine engine 10 via exhaust 26.

Figure 2:
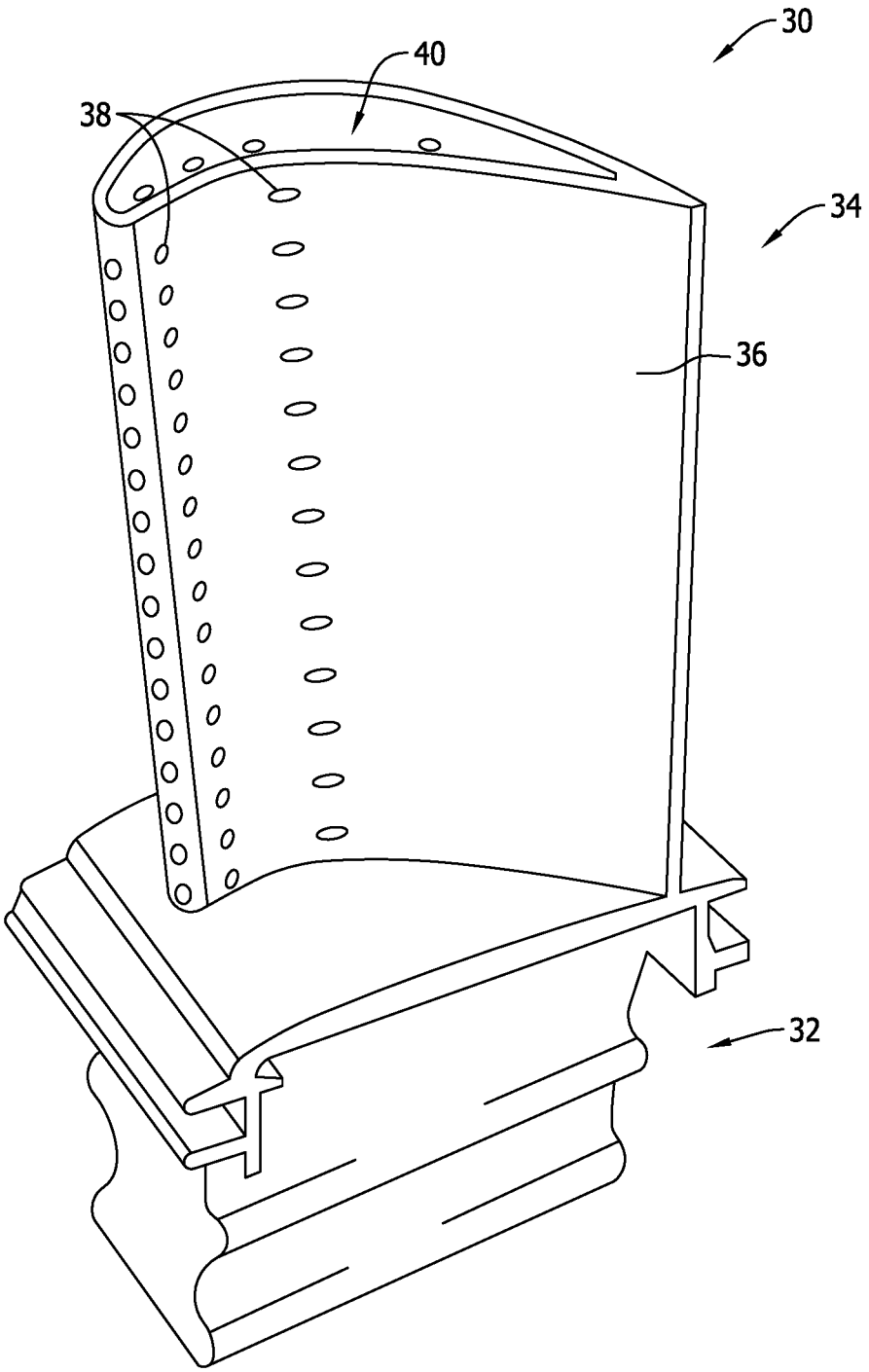
FIG. 2 is a perspective view of an exemplary turbine blade that may be used in the turbine engine shown in FIG. 1.

FIG. 2 is a perspective view of an exemplary turbine blade 30 that may be used in turbine engine 10 (shown in FIG. 1). In the exemplary embodiment, turbine blade 30 includes a root portion 32 and a blade portion 34 extending from root portion 32. Blade portion 34 includes a side wall 36 and a plurality of cooling holes 38 defined therein. Side wall 36 also defines an internal flow passage 40 extending therethrough. In one embodiment, as explained in more detail below, turbine blade 30 is manufactured in an investment casting manufacturing process. Moreover, while described in the context of turbine blade 30, the mold assembly and method described herein are applicable for forming any component having perforations or cooling holes defined therein.

Figure 3:
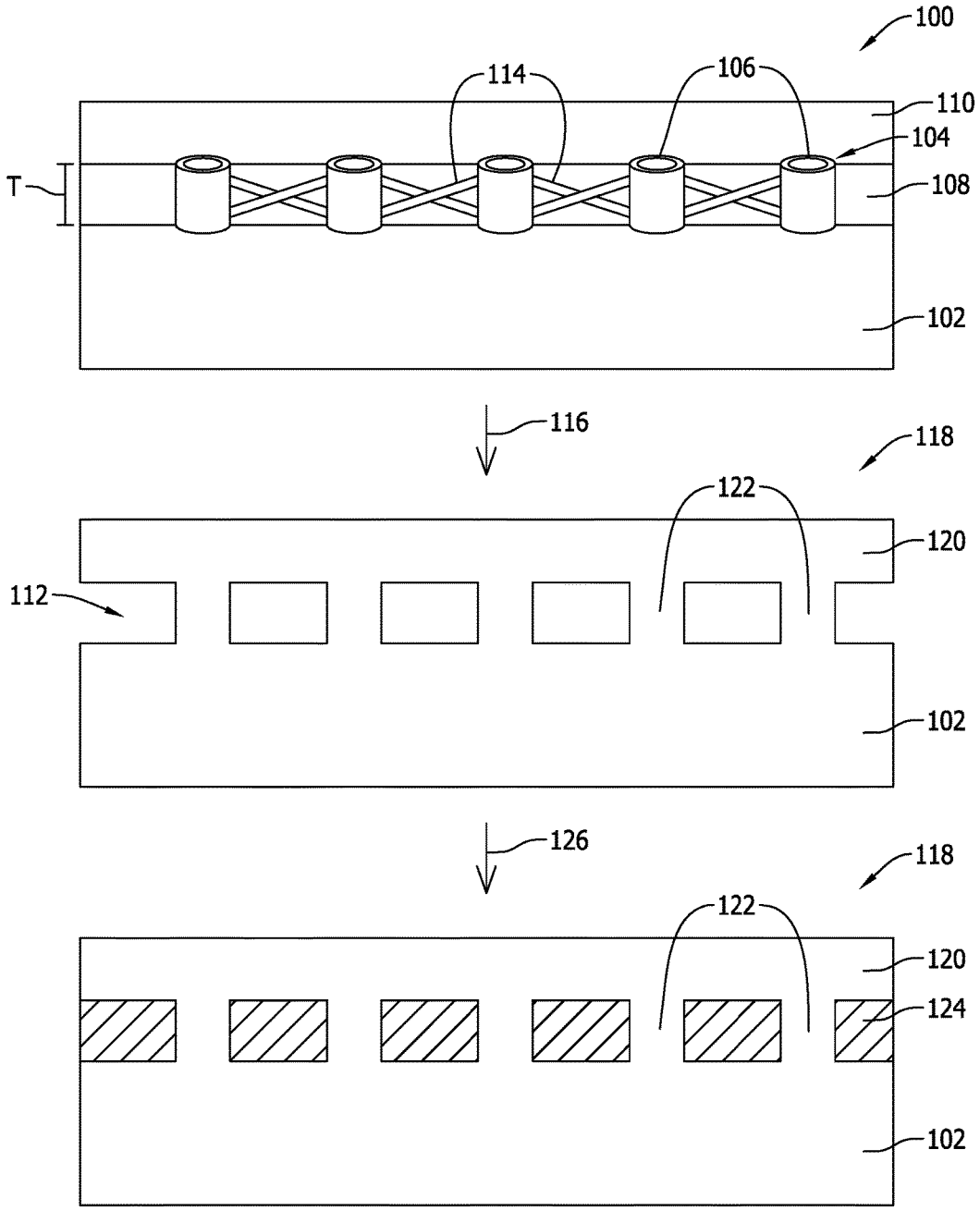
FIG. 3 illustrates an exemplary sequence of process steps for forming a component in an exemplary mold assembly.

FIG. 3 illustrates an exemplary sequence of process steps for forming a component in an exemplary mold assembly 100. In the exemplary embodiment, mold assembly 100 includes a mold core 102, an array 104 of receptacles 106 coupled to mold core 102, a layer 108 of fugitive material formed on mold core 102, and a layer 110 of uncured mold material formed on layer 108 of fugitive material. Layer 108 of fugitive material is formed such that array 104 of receptacles 106 is encapsulated within layer 108 of fugitive material. In addition, layer 108 of fugitive material has a thickness T such that at least a portion of array 104 is exposed for coupling to layer 110 of uncured mold material.

In one embodiment, mold core 102 and the uncured mold material are formed from the same material, which is any material that enables mold assembly 100 to function as described herein. An exemplary material used to form mold core 102 and the uncured mold material includes, but is not limited to, a ceramic material. As such, as will be explained in more detail below, mold core 102 and the uncured mold material are combined when heated 116 to a predetermined curing temperature, thereby forming a solidified mold assembly 118.

In addition, the fugitive material is any material that enables mold assembly 100 to function as described herein. An exemplary fugitive material includes, but is not limited to, a wax material. In the exemplary embodiment, the wax material has a vaporization temperature lower than the predetermined curing temperature of the ceramic material used to form mold core 102 and the uncured mold material. As such, as will be explained in more detail below, layer 108 of fugitive material is removed from between mold core 102 and layer 110 of uncured mold material when mold assembly 100 is heated to the predetermined curing temperature, thereby defining a mold cavity 112 within solidified mold assembly 118.

In the exemplary embodiment, array 104 includes a plurality of receptacles 106, and a plurality of spacing members 114 extending between receptacles 106 in array 104 such that receptacles 106 are interconnected. Moreover, the plurality of spacing members 114 are oriented in one or more dimensions for arranging receptacles 106 in a predetermined layout on mold core 102. For example, in one embodiment, mold core 102 is a contoured object, and array 104 of receptacles 106 is extended about mold core 102 in more than one dimension. As such, array 104 is quickly and easily positionable on mold core 102 when forming mold assembly 100. Alternatively, spacing members 114 are omitted from array 104, and receptacles 106 are individually positionable on mold core 102 when forming mold assembly 100.

Array 104, including receptacles 106 and spacing members 114, is fabricated from any material and in any manufacturing process that enables mold assembly 100 to function as described herein. In one embodiment, array 104 is at least partially fabricated in an additive manufacturing process. Exemplary materials used to fabricate array 104 include, but are not limited to, metallic material, polymeric material, and a combination thereof. The metallic material has a vaporization temperature greater than the predetermined curing temperature of the ceramic material used to form mold core 102 and the uncured mold material. As such, as will be explained in more detail below, array 104 remains positioned within mold cavity 112 as the uncured mold material contained therein is heated and solidifies, and the metallic material is configured for absorption into a metallic component material when introduced into mold cavity 112 of solidified mold assembly 118.

In addition, the polymeric material has a vaporization temperature lower than the predetermined curing temperature of the ceramic material. As such, as will be explained in more detail below, array 104 is removed from mold cavity 112 concurrently as the uncured mold material contained therein is heated and solidifies. When formed from the combination of metallic material and polymeric material, receptacles 106 are formed from polymeric material, an interior (not shown) of receptacles 106 are coated with metallic material. For example, in some embodiments, receptacles 106 are coated in an electroplating or electro-less plating process. As such, the shape of the uncured mold material within receptacles 106 is maintained by the metallic material as the polymeric material is removed from mold cavity 112.

As described above, mold assembly 100 is heated 116 to facilitate solidifying the uncured mold material contained within receptacles 106 and of layer 110 of uncured mold material, thereby forming solidified mold assembly 118. In addition, heating 116 mold assembly 100 facilitates vaporizing layer 108 of fugitive material for removal from solidified mold assembly 118. As such, solidified mold assembly 118 is formed from a unitary structure including mold core 102, a layer 120 of solidified mold material, and an array of pins 122 extending therebetween. In one embodiment, receptacles 106 in array 104 are shaped for extending linearly between mold core and layer 120 of solidified mold material, such that perforations having a linear orientation are formed in the component being formed (i.e., turbine blade 30). Moreover, in the exemplary embodiment, receptacles 106 in array 104 have an open top such that the uncured mold material in receptacles 106 and of layer 110 are combined when heated 116.

Moreover, removing layer 108 of fugitive material from solidified mold assembly 118 facilitates defining mold cavity 112 between mold core 102 and layer 120 of solidified mold material. A metallic component material 124 in a fluid state is then introduced 126 into mold cavity 112 of solidified mold assembly 118. The metallic component material 124 is allowed to cool and solidify within solidified mold assembly 118, thereby forming a cast component such as turbine blade 30. As such, in the context of turbine blade 30, mold core 102 corresponds to internal flow passage 40 (shown in FIG. 2), and pins 122 correspond to cooling holes 38 (shown in FIG. 2). More specifically, when removed from solidified mold assembly 118, the component formed from metallic component material 124 includes cooling holes 38 defined in positions vacated by the array of pins 122.

Figure 4:
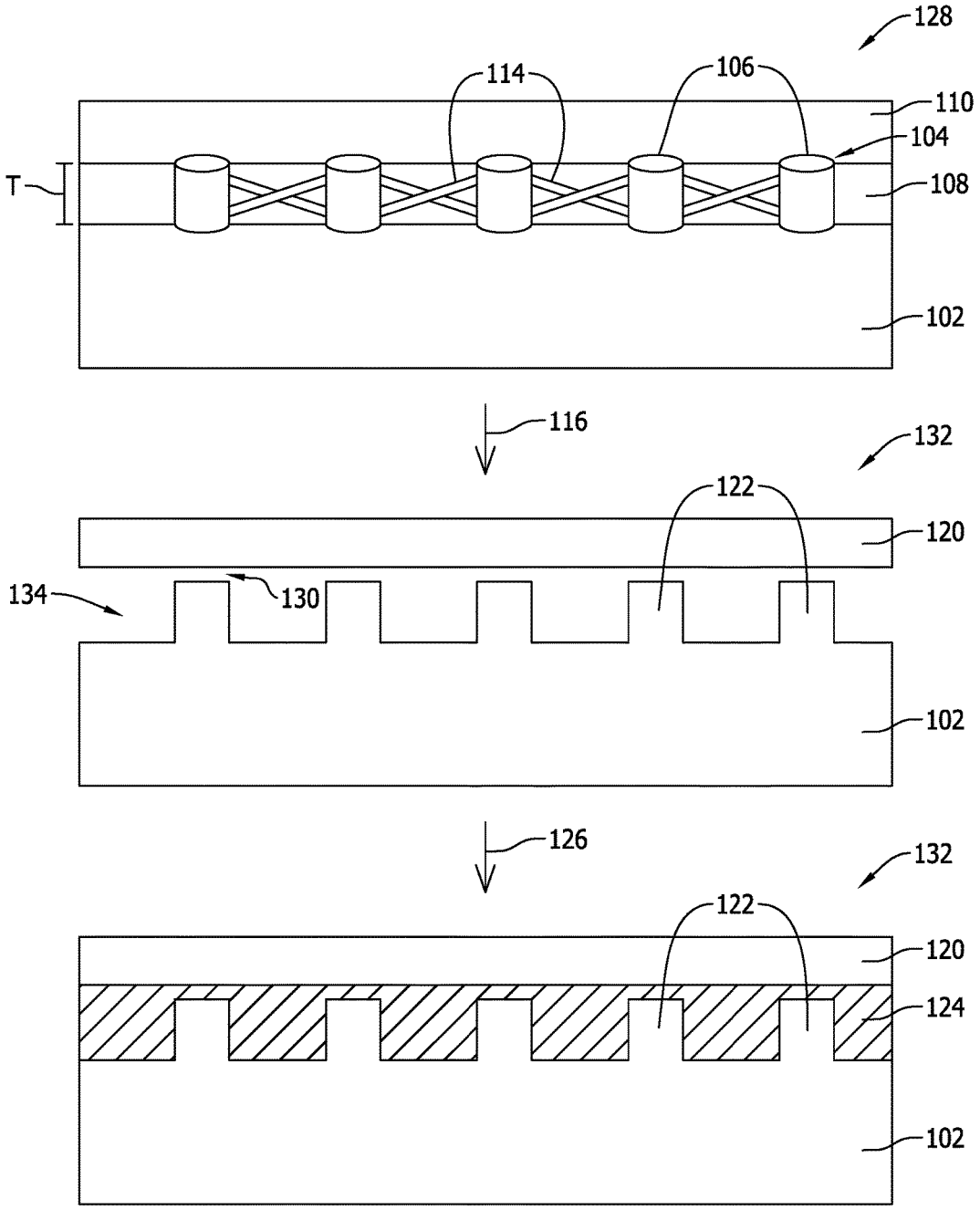
FIG. 4 illustrates an exemplary sequence of process steps for forming a component in an alternative mold assembly.

FIG. 4 illustrates an exemplary sequence of process steps for forming a component in an alternative mold assembly 128. In the exemplary embodiment, receptacles 106 in array 104 have closed top such that a gap 130 is defined between the uncured mold material in receptacles 106 and of layer 110 when heated 116. As such, solidified mold assembly 132 includes a mold cavity 134 including the space vacated by layer 108 of fugitive material and the gap 130. The metallic component material 124 is then introduced 126 into mold cavity 112 of solidified mold assembly 132, and metallic component material 124 is allowed to cool and solidify. When removed from solidified mold assembly 132, the component formed from metallic component material 124 includes a cap (not shown) of component material blocking cooling holes 38 (shown in FIG. 2). The component is then mechanically finished to facilitate defining perforations therein. In one embodiment, mold assembly 128 is used to selectively define a cooling hole pattern within the component. For example, some caps are mechanically finished and others are undisturbed based on a desired cooling hole pattern. Mechanical finishing includes, but is not limited to, drilling and electrochemical machining.

Figure 5:
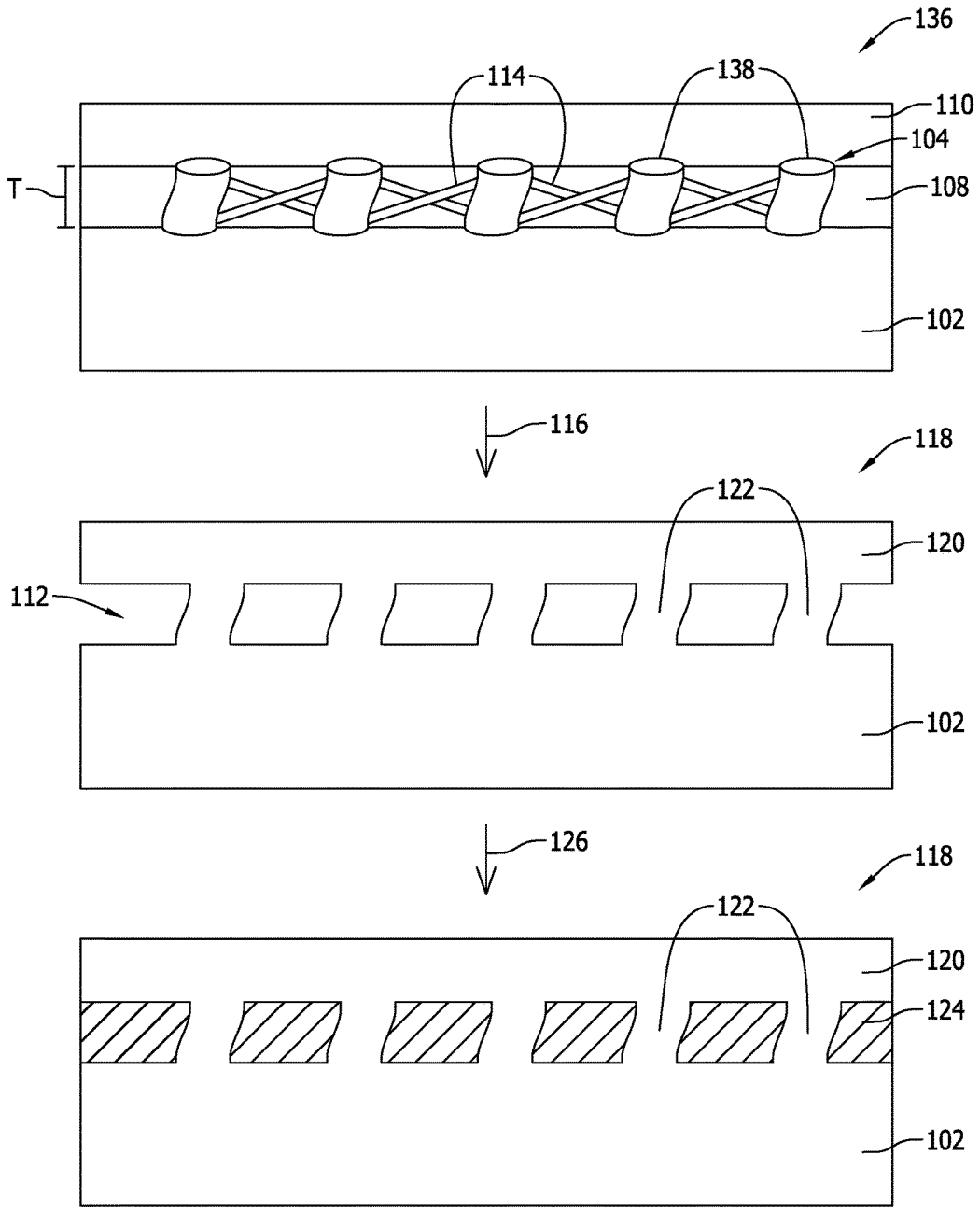
FIG. 5 illustrates an exemplary sequence of process steps for forming a component in further alternative mold assembly.

FIG. 5 illustrates an exemplary sequence of process steps for forming a component in an alternative mold assembly 136. In the exemplary embodiment, receptacles 138 in array 104 are shaped for extending non-linearly between mold core and layer 120 of solidified mold material, such that perforations having a non-linear orientation are formed in the component being formed (i.e., turbine blade 30). More specifically, receptacles 106 have any shape that enables mold assembly 136 to function as described herein. As such, cooling holes 38 in turbine blade 30 (both shown in FIG. 2), which correspond to receptacles 138, are formed with any flow geometry that enables turbine blade 30 to function as described herein.

The assemblies and methods described herein facilitate the formation of metallic cast components or objects having an array of perforations or cooling holes defined therein. Rather than casting the object and subsequently forming cooling holes therein, the mold assemblies described herein include an array of pins within a mold cavity of the assemblies. More specifically, the array of pins is formed by curing ceramic material in an array of receptacles in situ. A component material is then introduced into the mold cavity, and cooling holes are formed in the cast component in positions voided by the array of pins. As such, components having perforations or cooling holes defined therein are manufactured in a quick, efficient, and cost effective manner.

An exemplary technical effect of the assemblies and methods described herein includes at least one of: (a) forming a mold assembly that facilitates forming components having cast in perforations or cooling holes; (b) forming perforations or cooling holes having complex geometries within cast components; and (c) reducing the time and effort of forming perforations or cooling holes in a cast component.

Exemplary embodiments of investment casting assemblies and methods are provided herein. The assemblies and methods are not limited to the specific embodiments described herein, but rather, components of systems and/or steps of the methods may be utilized independently and separately from other components and/or steps described herein. For example, the configuration of components described herein may also be used in combination with other processes, and is not limited to practice with only manufacturing turbine components, as described herein. Rather, the exemplary embodiment can be implemented and utilized in connection with many applications where forming cast components having perforations or cooling holes is desired.

Although specific features of various embodiments of the present disclosure may be shown in some drawings and not in others, this is for convenience only. In accordance with the principles of embodiments of the present disclosure, any feature of a drawing may be referenced and/or claimed in combination with any feature of any other drawing.

This written description uses examples to disclose the embodiments of the present disclosure, including the best mode, and also to enable any person skilled in the art to practice embodiments of the present disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of forming a component, said method comprising:

coupling an array of receptacles to a mold core, wherein each receptacle in the array contains an amount of uncured mold material;

forming a layer of fugitive material on the mold core such that the array of receptacles is encapsulated within the layer of fugitive material;

forming a layer of uncured mold material on the layer of fugitive material, thereby forming an uncured mold assembly; and heating the uncured mold assembly to a temperature that solidifies the uncured mold material within each receptacle and of the layer, thereby forming an array of pins and a layer of solidified mold material, and heating the uncured mold assembly to the temperature that removes the layer of fugitive material from between the mold core and the layer of solidified mold material such that a mold cavity including the array of pins is defined therebetween.

2. The method in accordance with claim 1 further comprising introducing an amount of component material in a fluid state into the mold cavity.

3. The method in accordance with claim 2 further comprising:

cooling the component material to form the component; and removing the component from between the mold core and the layer of solidified mold material, wherein the component includes a plurality of cooling holes defined in positions vacated by the array of pins.

4. The method in accordance with claim 3 further comprising mechanically finishing the plurality of cooling holes.

5. The method in accordance with claim 2, wherein the array of receptacles is fabricated from a first material, wherein introducing an amount of component material comprises introducing the amount of component material at a temperature such that the first material is absorbed into the component material.

6. The method in accordance with claim 1, wherein the array of receptacles is fabricated from a second material, wherein heating the uncured mold assembly comprises heating the uncured mold assembly to the temperature that removes the second material from between the mold core and the layer of solidified mold material.

7. The method in accordance with claim 6, wherein the array of receptacles is coated with a layer of first material different from the second material, wherein heating the uncured mold assembly further comprises heating the uncured mold assembly to the temperature that removes the second material, and that maintains the layer of first material about the array of pins.

8. The method in accordance with claim 1, wherein forming a layer of fugitive material comprises forming the layer of fugitive material at a thickness such that the array of receptacles is coupled to the layer of uncured mold material.

9. The method in accordance with claim 1 further comprising forming the array of receptacles at least partially using an additive manufacturing process.

10. The method in accordance with claim 1, wherein coupling an array of receptacles comprises extending the array of receptacles about the mold core in more than one dimension.

11. A mold assembly comprising:

a mold core;

an array of receptacles coupled to said mold core, wherein each receptacle in said array contains an amount of uncured mold material;

a layer of fugitive material formed on said mold core such that said array of receptacles is encapsulated within said layer of fugitive material; and a layer of uncured mold material formed on said layer of fugitive material, wherein said array of receptacles is fabricated from material configured for removal from said mold assembly when heated to a temperature, and wherein the amount of uncured material defines an array of pins coupled to the mold core when the array of receptacles is heated.

12. The mold assembly in accordance with claim 11, wherein said array comprises a plurality of spacing members extending between receptacles in said array such that said receptacles are interconnected.

13. The mold assembly in accordance with claim 11, wherein said receptacles in said array are arranged in a predetermined layout on said mold core.

14. The mold assembly in accordance with claim 11, wherein at least one receptacle in said array is shaped for extending linearly between said mold core and said layer of uncured mold material.

15. The mold assembly in accordance with claim 11, wherein at least one receptacle in said array is shaped for extending non-linearly between said mold core and said layer of uncured mold material.

16. The mold assembly in accordance with claim 11, wherein each receptacle in said array has an open top.

17. The mold assembly in accordance with claim 11, wherein each receptacle in said array has a closed top.

18. The mold assembly in accordance with claim 11, wherein said array of receptacles is fabricated from a metallic material configured for absorption into a component material when introduced into said mold assembly.

19. The mold assembly in accordance with claim 11, wherein each receptacle in said array is coated with metallic material.

* * * * *